US006883259B2

(12) United States Patent
Johansson

(10) Patent No.: US 6,883,259 B2
(45) Date of Patent: Apr. 26, 2005

(54) CLOTHING DATA MARKER

(75) Inventor: Gert Johansson, Lerum (SE)

(73) Assignee: Mark Bric AB, Lerum (SE)

( * ) Notice: Subject to any disclaimer, the term of this patent is extended or adjusted under 35 U.S.C. 154(b) by 0 days.

(21) Appl. No.: 10/730,553

(22) Filed: Dec. 8, 2003

(65) Prior Publication Data

US 2004/0139634 A1 Jul. 22, 2004

Related U.S. Application Data

(60) Provisional application No. 60/431,830, filed on Dec. 9, 2002.

(51) Int. Cl.[7] ..... G09F 3/00
(52) U.S. Cl. ..... 40/322; 223/85
(58) Field of Search ..... 40/322, 316; 223/85, 223/88, 92

(56) References Cited

U.S. PATENT DOCUMENTS

| | | | | | |
|---|---|---|---|---|---|
| 3,898,754 | A | * | 8/1975 | Johansson | 40/322 |
| 4,679,340 | A | | 7/1987 | Johansson | |
| 5,586,697 | A | * | 12/1996 | Johansson | 223/85 |
| 5,590,822 | A | * | 1/1997 | Zuckerman | 223/85 |
| 6,029,868 | A | * | 2/2000 | Willinger et al. | 223/85 |
| D424,818 | S | * | 5/2000 | Willardson | D6/328 |
| 6,145,713 | A | | 11/2000 | Zuckerman | |
| D445,836 | S | * | 7/2001 | Willardson | D20/28 |
| 6,409,057 | B1 | * | 6/2002 | Kim | 223/85 |
| 2002/0095829 | A1 | * | 7/2002 | I-wen | 40/322 |

FOREIGN PATENT DOCUMENTS

| | | |
|---|---|---|
| GB | 1 510 479 | 11/1975 |

* cited by examiner

*Primary Examiner*—Gary C. Hoge
(74) *Attorney, Agent, or Firm*—Gauthier & Connors LLP

(57) ABSTRACT

A marker is disclosed that is adapted to fit onto a hook of a clothes hanger to convey information concerning a garment hung from the clothes hanger. In accordance with an embodiment of the invention, the marker includes an outer wall, a slot opening, a gate barb and a blocking barb. The gate bard and the blocking barb extend generally radially inwardly from the inner peripheral surface of the wall and are positioned on either side of the slot opening within the wall. The gate barb and the blocking barb are non-symmetrical to each other with respect to a plane that extends radially outwardly from the center of the marker through the slot opening and axially along a direction of the hanger hook within the marker. The gate barb flexes more than the blocking barb when the hanger hook is pushed radially inwardly through the slot opening into the marker. The blocking barb provides a substantial reactive blocking force along a longitudinal length of the blocking barb when the hanger hook is pushed radially outwardly from within the marker in an effort to remove the marker from the hanger.

15 Claims, 2 Drawing Sheets

CLOTHING DATA MARKER

PRIORITY CLAIM

This application claims priority to U.S. Provisional patent application Ser. No. 60/431,830 filed Dec. 9, 2002.

BACKGROUND

This invention relates to clothing data systems and more particularly to a marker of ring form for fitting onto a hook of a clothes hanger or the like. Markers have been employed for the identification of garments and other articles suspended in warehouses and for sale in shops and department stores. Such markers are both relatively inexpensive to produce and simple to use, but have certain inconveniences.

For example, U.S. Pat. No. 3,898,754 discloses a variety of clothing data markers that are generally formed as rings that fit onto a hook of a clothes hanger or the like. While certain embodiments are disclosed to be placed on the hook by sliding over the end of the hook, others (such as shown in FIG. 1*b* thereof) provide a slot through which a hanger hook stem may be received. Although such attachment via the side of a hanger hook may be preferred in certain situations, it is important that the data marker not be easily removed from the hanger hook.

U.S. Pat. No. 4,679,340 discloses a ring type clothing data marker that includes a slot 4 as well as radially projecting lugs 8 and a pair of inwardly directed converging wedge-shaped barbs 5 as shown in FIG. 1 thereof. The barbs are disclosed to be formed of a resilient material such that the barbs may be deflected laterally, permitting the hanger to be pressed through the slot. It has been found, however, that if the barbs are made sufficiently resilient to withstand excessive force used to remove the barbs, then the marker may be difficult to initially attach to the hanger, and if the barbs are made to be too flexible, the inability to remove the marker may be compromised.

There is a need, therefore, for an improved inexpensive clothing data marker that may be easily and readily attached to a hanger yet not be easily removed from the hanger.

SUMMARY OF THE INVENTION

The invention provides a marker that is adapted to fit onto a hook of a clothes hanger to convey information concerning a garment hung from the clothes hanger. In accordance with an embodiment of the invention, the marker includes an outer wall, a slot opening, a gate barb and a blocking barb. The wall generally extends longitudinally in the direction of the hook and defines a central traversing opening that is adapted to receive the clothes hanger hook. The wall includes an inner peripheral surface and an outer peripheral surface. The outer peripheral surface of the wall bears the information. The slot opening is within the wall extending over the entire longitudinal length thereof. The slot permits passage laterally of the hook through the slot for mounting of the marker to the clothes hanger hook. The gate barb and the blocking barb extend generally radially inwardly from the inner peripheral surface of the ring wall and are positioned on either side of the slot opening within the wall. The gate barb and the blocking barb are non-symmetrical to each other with respect to a plane that extends radially outwardly from the center of the marker through the slot opening and axially along a direction of the hanger hook within the marker. The gate barb flexes more than the blocking barb when the hanger hook is pushed radially inwardly through the slot opening into the marker. The blocking barb provides a substantial reactive blocking force along a longitudinal length of the blocking barb when the hanger hook is pushed radially outwardly from within the marker in an effort to remove the marker from the hanger.

A plurality of lugs may also be employed in other embodiments to extend generally radially inwardly from the inner peripheral surface of the wall generally towards the center of the wall, at circumferentially spaced positions such that the lugs contribute to centering the wall on said clothes hanger hook. In accordance with further embodiments, the gate barb includes a radially inner surface that serves to deflect the hanger hook away from the slot opening. In further embodiments, the gate barb includes a radially inward tip that is defined between a generally rounded radially outer surface and a generally flat radially inner surface. In further embodiments, the blocking barb includes a radially outer surface adjacent the slot opening that contributes to guiding the hanger hook toward the center of the marker when the hanger hook is pushed radially inwardly through the slot opening into the marker. In further embodiments, the blocking barb includes a radially inner end portion that includes a generally flat surface against which the hanger hook may be contacted when the hanger hook is pushed radially outwardly from within the marker in an effort to remove the marker from the hanger.

BRIEF DESCRIPTION OF THE DRAWINGS

The following description may be further understood with reference to the accompanying drawings in which.

The drawings are shown for illustrated purposes only and are not to scale.

DESCRIPTION OF THE ILLUSTRATED EMBODIMENTS

Figure 1:
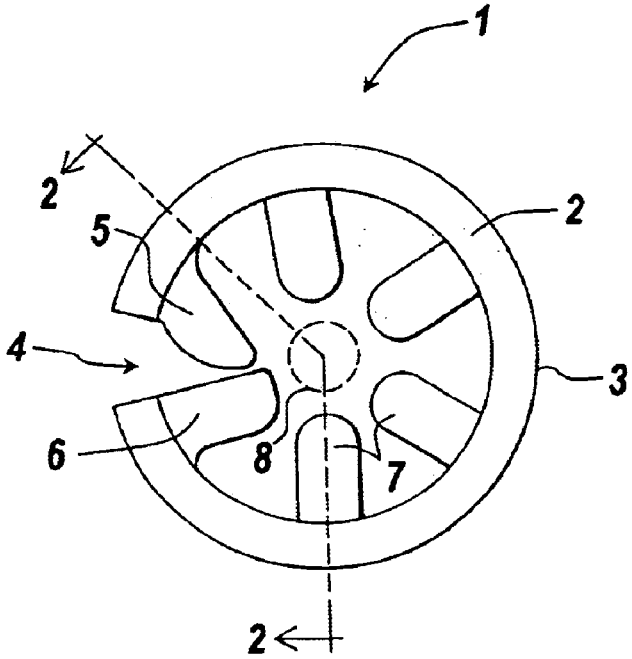
FIG. 1 shows an illustrative top plan view of a clothing data marker in accordance with an embodiment of the invention.
Figure 3:
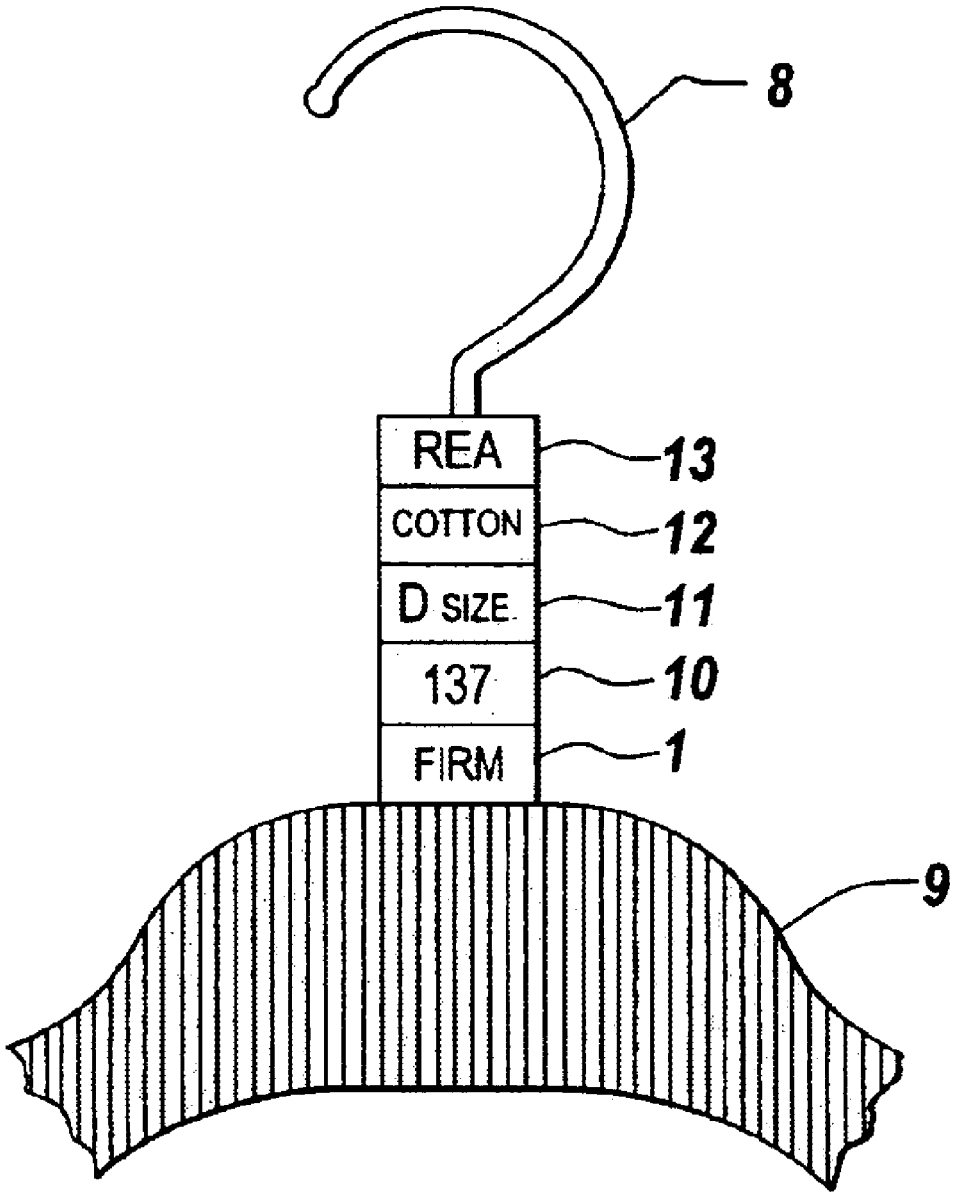
FIG. 3 shows an illustrative side view of a portion of a hanger, the hook of which bears a number of markers of the form shown in FIGS. 1 and 2.

As shown in FIG. 1, a marker, indicated generally at 1 includes a circular wall 2 defining an outer vertical side surface 3 that is intended and adapted to carry alphanumeric data or information as seen in FIG. 3. The marker ring wall 2 is provided with a vertical slot 4 that traverses the full vertical height of wall 2. The width of the outer opening of slot 4 is in excess of the diameter or width of hook 8, which is shown in FIG. 1 as being centered therein after passage therethrough. Two inwardly directed, converging barbs 5 and 6 are integrally formed or otherwise affixed to the inner periphery of ring wall 2 on either side of the slot 4 with the ends portions of the barbs 5 and 6 being either in contact with each other or situated very close to each other to define a narrow passage for the hook 8 that is significantly smaller than the diameter of the hook 8.

The first barb 5 is provided as a gate barb and the second barb 6 is provided as a blocking barb. The gate bard 5 flexes more than the blocking barb 6 upon insertion of a hanger hook through the slot 4. The blocking barb 6 provides a very strong resistance to a force exerted radially outwardly due to a hook being removed through the slit 4. The inner surface of the gate barb 5 also serves to deflect a hanger hook away from the slot 4 upon attempts to remove the marker from a hanger radially, and the outer surface of the blocking barb 6 also helps to guide the hanger hook into the center of the mark upon receiving a hanger hook. The gate barb and the blocking barb are therefore non-symmetrical to each other with respect to a plane that extends radially outwardly from the center of the marker through the slot opening and axially along a direction of the hanger hook within the marker.

The ring wall 2 also has on its inner periphery a plurality of radially projecting lugs 7 that are circumferentially spaced about the inner periphery of the ring wall 2 and spaced from the barbs 5 and 6 at slot 4 as shown. The hook 8 upon entering the interior of the marker ring abuts the lugs 7, which may be of fixed or varying length. Preferably, the ring wall 2, the barbs 5 and 6, and the lugs 7 are integrally formed of a molded resilient plastic. When placing the marker 1 on the hook 8, the elasticity of wall 2 and of the barbs 5 and 6 will each contribute to allowing the barbs 5 and 6 to be displaced away from one another, that is, deflected laterally, thus enabling the marker 1 to be placed on the hook 8 by pressing the marker laterally with the slot aligned with the side of hook.

Figure 2:
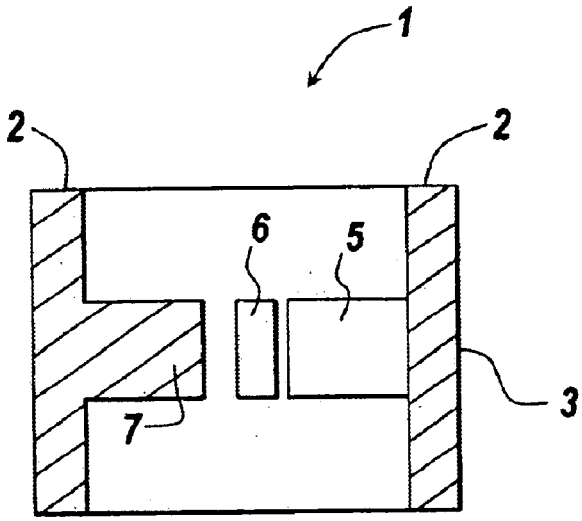
FIG. 2 shows an illustrative sectional view of the marker of FIG. 1 taken along lines 2—2 thereof.

As shown in FIG. 2, the inner end of the barb 6 provides a firm surface against which a removal force may be received. Such a force will be directed along the longitudinal length of the barb 6 as shown in FIG. 1. As also shown in FIG. 2, the inner surface of the barb 5 provides a relatively broad surface along which a removal force will be directed by the barb 5 away from the slot 4. The axial lengths of barbs 5 and 6, and the lugs 7 extend roughly one-third of the total axial length of the ring wall 2.

FIG. 3 shows a series of markers as a 1, 10, 11, 12 and 13 placed in ascending order on the hook 8 of the clothes hanger 9. The marker 1 is attached by aligning its axis coaxial with the axis of hook 8 where it meets the body of the clothes hanger 9 with slot 4 facing the side of hook 8. By laterally pressing the marker against the hook 7, it will move through the slot deflecting the barbs 5 and 6 until the hook moves into the center of the marker 1 where it contacts lugs 7. The additional markers 10, 11, 12 and 13 are placed on the hook in the same fashion by pressing them laterally onto the hook as by finger pressure. The marker 1 may bear on its periphery information concerning a trademark as represented by the word FIRM. Marker 10 shows numeric information related to clothing article size. Marker 11 provides size variant data. Marker 12 provides fiber type data, e.g., COTTON, while marker 13 may bear special sales information represented by letters REA. As appreciated, various types of data may be provided in alphanumeric form which may be visually read or machine read.

Thus, according to the invention, information carrying units or tallies, for example, in the form of rings are provided with alphanumeric data or information on the peripheries thereof and are attached to the devices, for example, clothes hangers or clothes pegs which directly carry the garment. It is generally best to fit units to the hooks with which the clothes carrying devices are suspended on clothes rails or the like, and each individual unit should contain only a limited quantity of information. The present invention has a number of advantages, some of the more important of which are set out below. Thus, it provides a clear and uniform identification of each individual garment and reduces the risk of confusion of garments and of uncertainty on the part of customers and shop assistants. The markers save time for both sales personnel as well as retail customers, and the markers may be seen from many directions. The invention thereby provides a locking device for the marker that significantly improves the resistance to removing a marker without significantly impacting the force needed to insert a hanger hook into the center of the marker. The invention also offers a relatively inexpensive marker since the cost of the marker material is low and the amount of material required is minimized.

Those skilled in the art will appreciate that numerous changes and modifications may be made to the above disclosed embodiments without departing from the spirit and scope of the invention.

What is claimed is:

1. A marker adapted to fit onto a hook of a clothes hanger to convey information concerning a garment hung from the clothes hanger, said marker comprising:

an outer wall extending longitudinally in the direction of the hook and defining a central traversing opening that is adapted to receive the clothes hanger hook, said outer wall including an inner peripheral surface and an outer peripheral surface, the outer peripheral surface bearing the information;

a slot opening within said wall extending over the entire longitudinal length thereof, said slot permitting passage laterally of the hook through said slot for mounting of said marker to the clothes hanger hook; and a gate bard and a blocking barb extending generally radially inwardly from the inner peripheral surface of said outer wall and being positioned on either side of said slot opening within said outer wall, said gate barb and said blocking barb being non-symmetrical to each other with respect to a plane that extends radially outwardly from the center of the marker through the slot opening and axially along a direction of the hanger hook within the marker, said gate barb flexing more than said blocking barb when the hanger hook is pushed radially inwardly through the slot opening into the marker, and said blocking barb providing a substantial reactive blocking force along a longitudinal length of said blocking barb when the hanger hook is pushed radially outwardly from within the marker in an effort to remove the marker from the hanger.

2. The marker as claimed in claim 1, wherein said gate barb includes a radially inner surface that serves to deflect the hanger hook away from the slot opening.

3. The marker as claimed in claim 2, wherein said gate barb includes a radially inward tip that is defined between a generally rounded radially outer surface and a generally flat radially inner surface.

4. The marker as claimed in claim 1, wherein said blocking barb includes a radially outer surface adjacent said slot opening that contributes to guiding the hanger hook toward the center of the marker when the hanger hook is pushed radially inwardly through the slot opening into the marker.

5. The marker as claimed in claim 4, wherein said blocking barb includes a radially inner end portion that includes a generally flat surface against which the hanger hook may be contacted when the hanger hook is pushed radially outwardly from within the marker in an effort to remove the marker from the hanger.

6. A marker adapted to fit onto a hook of a clothes hanger to convey information concerning a garment hung from the clothes hanger, said marker comprising:

a generally cylindrical ring wall extending longitudinally in the direction of the hook and defining a central traversing opening that is adapted to receive the clothes hanger hook, said ring wall including an inner peripheral surface and an outer peripheral surface, the outer peripheral surface bearing the information;

a slot opening within said wall extending over the entire longitudinal length thereof, said slot permitting passage laterally of the hook through said slot for mounting of said marker to the clothes hanger hook; and a gate barb and a blocking barb extending generally radially inwardly from the inner peripheral surface of said ring wall and being positioned on either side of said slot opening within said ring wall, said gate barb and said blocking barb being non-symmetrical to each other with respect to a plane that extends radially outwardly from the center of the marker through the slot opening and axially along a direction of the hanger hook within the marker, said gate barb flexing more than said blocking barb when the hanger hook is pushed radially inwardly through the slot opening into the marker, and said blocking barb providing a substantial reactive blocking force along a longitudinal length of said blocking barb when the hanger hook is pushed radially outwardly from within the marker in an effort to remove the marker from the hanger.

7. The marker as claimed in claim 6, wherein said gate barb includes a radially inner surface that serves to deflect the hanger hook away from the slot opening.

8. The marker as claimed in claim 7, wherein said gate barb includes a radially inward tip that is defined between a generally rounded radially outer surface and a generally flat radially inner surface.

9. The marker as claimed in claim 6, wherein said blocking barb includes a radially outer surface adjacent said slot opening that contributes to guiding the hanger hook toward the center of the marker when the hanger hook is pushed radially inwardly through the slot opening into the marker.

10. The marker as claimed in claim 9, wherein said blocking barb includes a radially inner end portion that includes a generally flat surface against which the hanger hook may be contacted when the hanger hook is pushed radially outwardly from within the marker in an effort to remove the marker from the hanger.

11. A marker adapted to fit onto a hook of a clothes hanger to convey information concerning a garment hung from the clothes hanger, said marker comprising:

a generally cylindrical ring wall extending longitudinally in the direction of the hook and defining a central traversing opening that is adapted to receive the clothes hanger hook, said ring wall including an inner peripheral surface and an outer peripheral surface, the outer peripheral surface bearing the information;

a slot opening within said wall extending over the entire longitudinal length thereof, said slot permitting passage laterally of the hook through said slot for mounting of said marker to the clothes hanger hook;

a plurality of lugs extending generally radially inwardly from the inner peripheral surface of said ring wall generally towards the center of the cylindrical ring wall, at circumferentially spaced positions such that said lugs contribute to centering said ring wall on said clothes hanger hook; and a gate barb and a blocking barb extending generally radially inwardly from the inner peripheral surface of said ring wall and being positioned on either side of said slot opening within said ring wall, said gate barb and said blocking barb being non-symmetrical to each other with respect to a plane that extends radially outwardly from the center of the marker through the slot opening and axially along a direction of the hanger hook within the marker, said gate barb flexing more than said blocking barb when the hanger hook is pushed radially inwardly through the slot opening into the marker, and said blocking barb providing a substantial reactive blocking force along a longitudinal length of said blocking barb when the hanger hook is pushed radially outwardly from within the marker in an effort to remove the marker from the hanger.

12. The marker as claimed in claim 11, wherein said gate barb includes a radially inner surface that serves to deflect the hanger hook away from the slot opening.

13. The marker as claimed in claim 12, wherein said gate barb includes a radially inward tip that is defined between a generally rounded radially outer surface and a generally flat radially inner surface.

14. The marker as claimed in claim 11, wherein said blocking barb includes a radially outer surface adjacent said slot opening that contributes to guiding the hanger hook toward the center of the marker when the hanger hook is pushed radially inwardly through the slot opening into the marker.

15. The marker as claimed in claim 14, wherein said blocking barb includes a radially inner end portion that includes a generally flat surface against which the hanger hook may be contacted when the hanger hook is pushed radially outwardly from within the marker in an effort to remove the marker from the hanger.

* * * * *